United States Patent [19]

Woods et al.

[11] 4,189,360

[45] Feb. 19, 1980

[54] PROCESS FOR CONTINUOUS ANODIZING OF ALUMINUM

[76] Inventors: Jack L. Woods; Craig P. Woods, both of P.O. Box 1559, Ogden, Utah 84402

[21] Appl. No.: 19,348

[22] Filed: Mar. 12, 1979

[51] Int. Cl.[2] ..... C25D 11/04; C25D 17/00; C25D 17/04

[52] U.S. Cl. ..... 204/58; 204/42; 204/198; 204/202; 204/205

[58] Field of Search ..... 204/198, 202, 204, 205, 204/58, 42, 228

[56] References Cited

U.S. PATENT DOCUMENTS

| | | | |
|---|---|---|---|
| 3,079,308 | 2/1963 | Ramirez et al. | 204/28 |
| 3,592,754 | 7/1971 | Aihara | 204/297 |
| 4,089,756 | 5/1978 | Lerner et al. | 204/58 |

*Primary Examiner*—G. L. Kaplan
*Attorney, Agent, or Firm*—Criddle & Western

[57] ABSTRACT

This invention relates to a process for mass-production formation of aluminum oxide coatings on a plurality of aluminum or aluminum alloy articles by means of continuous anodic oxidation. The process is characterized by connecting one or more of the aluminum articles to the positive terminal of a power supply capable of maintaining constant current. Depending on the volume of work to be anodized, two or more power supplies are utilized with the negative terminals connected to common cathodes of a common anodizing tank and the positive terminals being electrically isolated from each other. Individual racks containing one or more aluminum articles are brought into contact with the positive terminals of the power supplies. Contact is made through a series of segmented bus bars of positive electrical potential corresponding to the number of power supplies and a system is used to move the racks through the common anodizing tank. Thus, continuous anodizing of one or a plurality of articles is accomplished.

10 Claims, 3 Drawing Figures

PROCESS FOR CONTINUOUS ANODIZING OF ALUMINUM

BACKGROUND OF THE INVENTION

This invention relates to a method to continuously anodize a plurality of aluminum articles or pieces. Further, the anodic coating uniformity and quality is exceptionally high.

Over the years many methods have been tried to automate the anodizing of aluminum articles and/or improve the quality of the oxide coating. These methods have had varying degrees of success. For examples, U.S. Pat. No. 3,079,308 discloses a system for continuously anodizing sheet aluminum but this process cannot anodize piece parts. U.S. Pat. No. 3,592,754 overcomes the problem of non-uniform coatings but the disclosed apparatus is cumbersome and not suitable for high volume automatic continuous anodizing. U.S. Pat. No. 4,089,756 discloses another method in the attempt to automate piece part hard anodizing. This process requires several individual anodizing tanks which must be electrically isolated from each other.

OBJECTS AND BRIEF DESCRIPTION OF THE INVENTION

It is an object of this invention to provide a process for the continuous mass production of high quality anodic coatings on aluminum and aluminum alloys at high production rates.

It is also an object of this invention to provide a process for the continuous mass production of anodic coatings on aluminum and its alloys using a common anodizing tank and a plurality of electrical power supplies wherein the aluminum or alloy being anodized is made anodic by each power supply in sequence.

A further object of this invention is to provide a method for the continuous mass production of anodic coatings on aluminum and its alloys wherein a common anodizing tank is used as the cathode for a plurality of electric power supplies and wherein the positive terminals of each power supply are electrically isolated from each other.

A still further object of the present invention is to provide a method for the continuous mass production of anodic coatings on aluminum and its alloys wherein a common anodizing tank is used as a cathode for a plurality of electric power supplies which are capable of maintaining constant current and where the positive terminals of the electric power supplies are electrically isolated from each other by means of a segmented bus bar.

These and other objects are accomplished by means of a continuous process wherein a series of separate power supplies are used with a common anodizing tank containing a common anodizing electrolyte. If the anodizing tank is of appropriate material it is used as a common cathode by being in contact with the negative terminal of each power source. Otherwise, lead or stainless steel could be inserted into the anodizing tank for use as cathodes. The positive terminals of each power source are connected to a segmented bus bar having insulated segments such that each positive terminal is electrically isolated from the others. The aluminum articles to be anodized are attached to an insulated conveying rack and suspended in a liquid anodizing electrolyte. The aluminum articles are made anodic by sequentially connecting the conveying rack to the bus bar by means of a sliding electrical contact which will traverse the length of the bus bar as the rack is drawn through the electrolyte in the anodizing tank. The sliding electrical contact is dimensioned such that it will more than span the insulated segments of the bus bar so that electrical contact between the bus bar and aluminum articles, which serve as the anodes, will be preserved as the sliding contact moves from being in electrical contact with one power supply to another. Means are provided for drawing the conveying racks into, through and out of the anodizing tank. Only one conveying rack is in electrical contact with one positive electrical terminal at a time.

In this manner a series of conveying racks may be utilized in a common anodizing tank at one time and the aluminum articles held in such racks will be subjected to the desired current density for a time sufficient to produce an anodic coating to the desired thickness and hardness.

DRAWINGS OF THE INVENTION

DETAILED DESCRIPTION OF THE INVENTION

Figure 1:
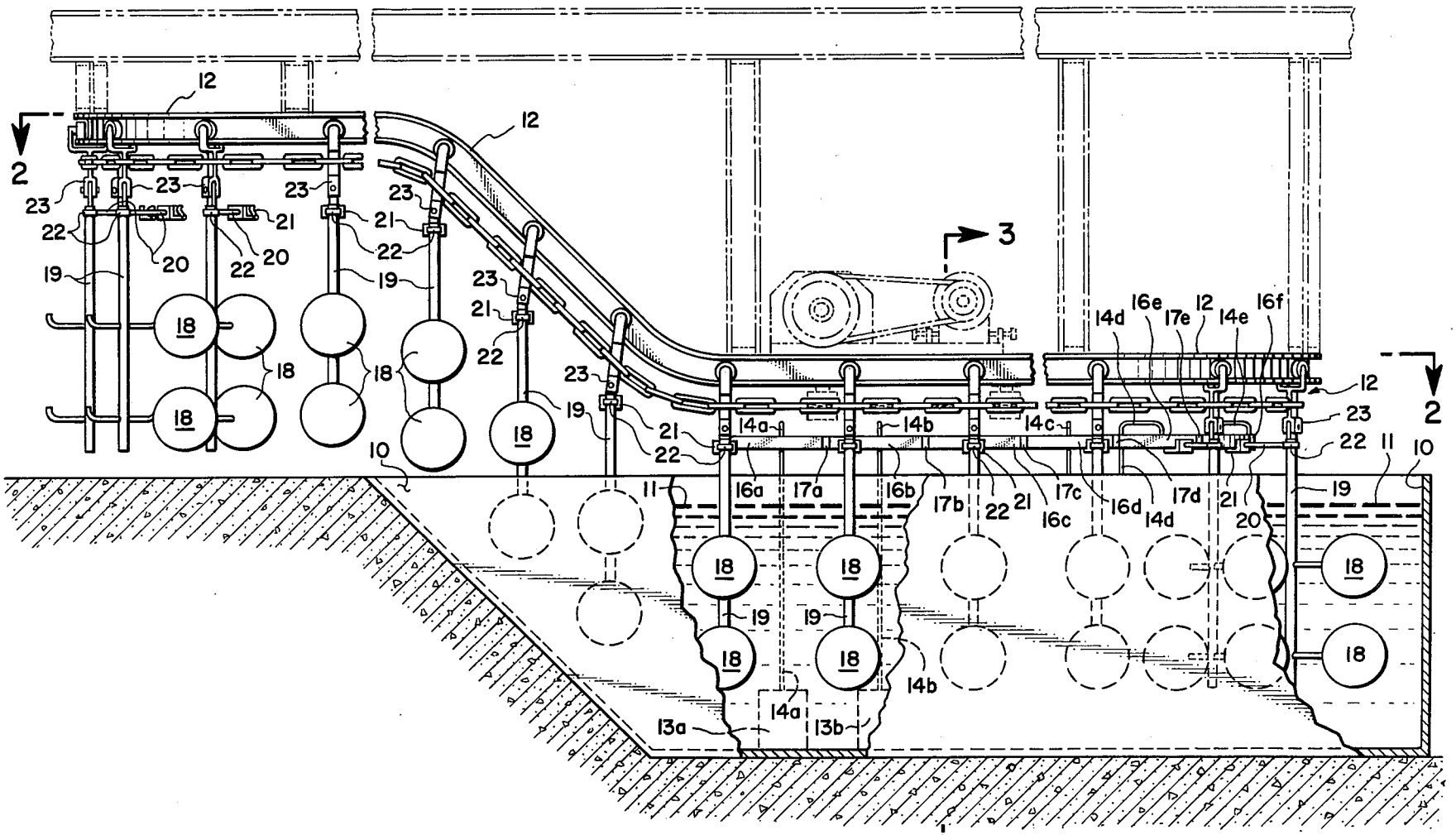
FIG. 1 is a side elevational view of an anodizing system with the tank partially broken away and the conveyer support and drive means shown in phantom lines.
Figure 2:
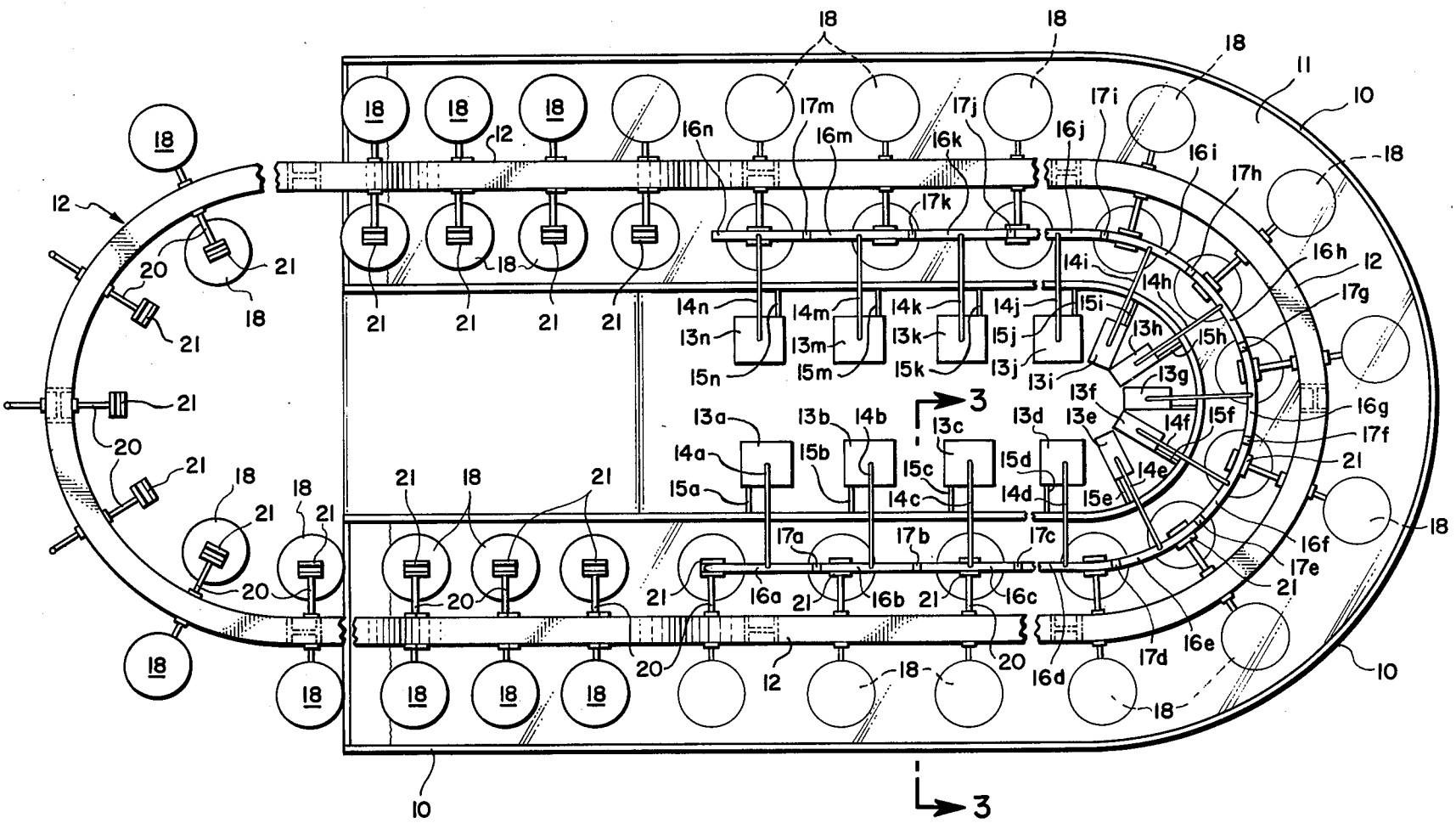
FIG. 2 shows a top view of an anodizing system taken along lines 2—2 of FIG. 1 showing an anodizing tank, segmented bus bar, conveyer and multiple power supplies.
Figure 3:
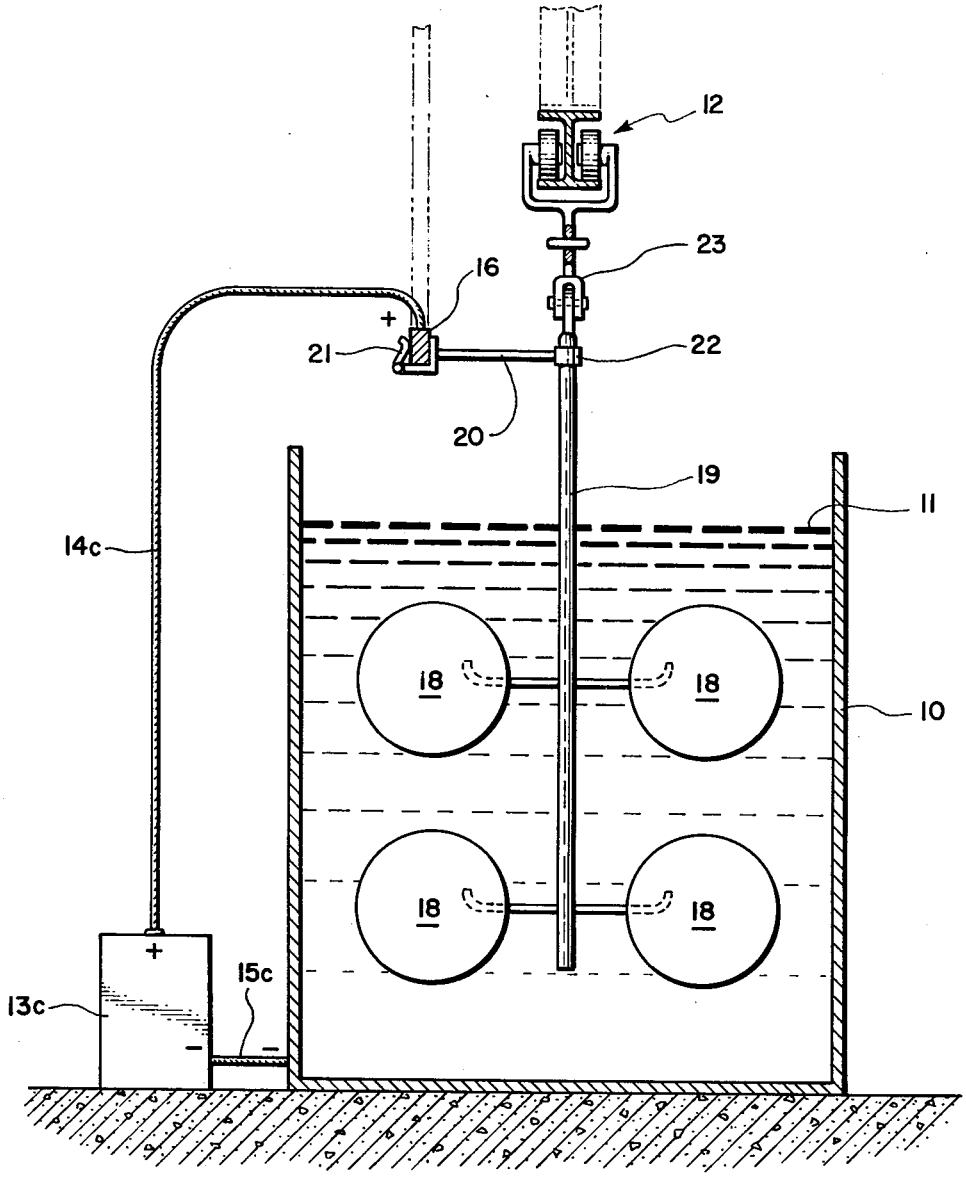
FIG. 3 is a transverse sectional view of the anodizing system taken along lines 3—3 of FIGS. 1 and 2

There is shown in FIGS. 1-3 a complete operative embodiment of the invention. Preliminary steps such as cleaning and deoxidizing of the aluminum as well as other steps, such as bright dipping, prior to anodizing are not shown and are well described in the literature and known to those skilled in the art.

FIG. 1 shows a system comprising an anodizing tank 10, filled with an appropriate acid electrolyte 11. Conveyer means 12 are provided to direct the aluminum articles being anodized through the electrolyte in the anodizing tank. A plurality of electric power supplies, 13*a, b, c,* etc. having positive terminals 14*a, b, c,* etc, and negative terminals 15*a, b, c,* etc. and which are capable of maintaining constant current are provided. As illustrated, the anodizing tank 10 becomes the cathode by attachment of all negative terminals 15*a, b, c,* etc, to the tank.

A segmented bus bar 16 is divided into separate, electrically isolated segments 16*a, b, c,* etc. by insulators 17*a, b, c,* etc. A positive terminal 14*a, b, c,* etc. from the corresponding power supplies 13*a, b, c,* etc. is connected to the appropriate bus bar segment 16*a, b, c,* etc. The bus bar 16 and the conveyer 12 run parallel to each other and are suspended over the anodizing tank 10. The length and dimensions of the anodizing tank 10 may be varied to suit the size and quantity of the articles to be anodized in a continuous operation. When tank 10 is made of stainless steel the tank itself becomes the cathode by connecting the negative terminals 15 of the power supplies 13 to the tank as already described. It is obvious that a lead lined tank could be used as the cathode or a plastic tank could be used and lead or stainless steel inserted in the tank for use as cathodes. The conveyer 12 is similar to those conventionally used for transporting articles around factories, into spray paint booths and the like. Any type of simple conveyer which has attachment fittings for hanging parts at a definite spacing is suitable.

FIGS. 1–3 illustrate the means by which the various power supplies 13 are attached to the bus bar 16 at their positive terminals and are kept electrically isolated from each other. It is to be noted that the number of power supplies used depends upon the quantity of articles to be covered with an anodic coating and the time and current that will be necessary to produce such a coating. At a minumum, two power supplies are required, however, the maximum is infinite.

The bus bar 16 forms a track of conductive material such as copper or aluminum which is segmented into parts 16*a, b, c,* etc, of equal length which are separated from each other by segments 17*a, b, c,* etc, of non-conductive material such as rubber or a non-conductive polymer, copolymer, block copolymer or resin. The non-conductive or insulative segments 17*a, b, c,* etc, are of the same shape as conductive segments 16*a, b, c,* etc, such that the bus bar is of one continuous length and shape. The positive terminal of each power supply is connected to its correspondingly lettered bus bar segment. Thus terminal 14*a* is connected to bus bar segment 16*a* and to no other bus bar segment. It is important that the positive terminal of each power supply remains electrically isolated from the positive terminal of each other power supply. This is accomplished by insulators 17*a, b, c,* etc. For example, insulator segment 17*a* electrically isolates bus bar segment 16*a* and 16*b*. However it is important to remember that a common electrolyte and anodizing tank is being utilized to anodize articles receiving power from a plurality of individual power supplies.

The articles to be anodized serve as the anodes and therefore must be electrically connected to the various power supplies 13 via the bus bar 16. Articles 18 are made of aluminum or aluminum alloys and may come in various sizes and shapes such as sheets, pistons, cylinders, gears, door and window frames, etc. These articles are usually engaged or held in a rack 19 for the anodizing process. Rack 19 may be suspended directly from bus bar 16 and may be made of any suitable electrically conducting material. However, in actual practice as illustrated, rack 19 is preferably detachably suspended from a hanger 23 moving along conveyer 12 and is electrically connected to bus bar 16 via a connecting link 20. Link 20 is attached at one end to a slidable contact 21 which is adapted to fit about and mechanically move along bus bar track 16. At the other end of link 20 is a clamp 22 or other means to physically and electrically attach link 20 to rack 19. When operated in this manner rack 19 must be electrically insulated at the top from hanger 23 and conveyer 12 if a metal conveyer and hanger are used. If a plastic conveyer and/or hanger is used the rack 19 would not require being insulated. Assuming the conveyer 12 to be of metal hanger 23 would preferably be made of non-conductive material such as a resinous or polymeric material.

In operation, a rack holding prepared aluminum articles 18 to be anodized is suspended from hanger 23 on conveyer 12. Link 29 is attached to rack 19 via clamp 22 and rack 19 is lowered into a liquid acid electrolyte 11 contained in a stainless steel anodizing tank 10. Link 20 is also connected via a slidable contact 21 to a segmented bus bar 16 having segments 16*a, b, c,* etc. Which are electrically isolated from each other. A plurality of power supplies 13*a, b, c,* etc. is provided having the positive terminal 14*a, b, c,* etc. thereof connected to the correspondingly lettered bus bar segment 16*a, b, c,* etc. The negative terminals 15*a, b, c,* etc, are connected to the stainless steel tank 10.

Conveyer 12 moves hanger 23, rack 19 and link 20 along the length of bus bar 16 such that slidable contact 21 makes contact with segments 16*a, b, c,* etc. in sequence making the aluminum articles anodic by the positive current supplied by different power supplies 13*a, b, c,* etc.

As rack 19 clears power supply 13*a,* another rack may be brought into contact with their power supply. Thus racks 19 are spaced so that only one rack is subject to power supplied from a single power supply at a time. In other words a single power supply 13 supplies electrical current to only one rack 19 at a time. Thus the spacing between racks 19 exceeds the length of bus bar segments 16*a, b, c,* etc. However, in order to provide uninterrupted current to the article 18 being anodized in each rack 19, the sliding contact 21 is slightly longer than each insulative strip 17. This is necessary so that as the slidable contact 21 passes from one bus bar segment to another, e.g. from 16*a* to 16*b*, the insulative segment, e.g. 17*a,* is bridged and rack 19 is momentarily in electrical contact with two power supplies e.g. 13*a* and 13*b* at the same time. Thus, one power supply is never in electrical contact with two racks but momentarily two power supplies are in electrical contact with one rack.

In accomplishing the bridging of the segment insulation 17, two power supplies are placed in parallel for a moment. Thus, uninterrupted current flows to the anodizing rack 19 and the power supplies e.g. 13*a* and 13*b*, are not overloaded and full current is maintained on the articles 18. Since the power supplies maintain the desired current automatically it would do no harm if by chance two racks 19 contacted one bus bar segment 16*a, b, c,* etc, at the same time other than the articles 18 would receive only approximately one half their desired amperage and the resulting anodic coating would be thinner than that desired. In some unusual anodizing applications it may be desired to space the electrical sliding contacts 21 feeding the individual racks 19 so that the current was stopped as the contact 21 moved across the insulation 17 between the bus bar segments 16*a, b, c,* etc. This would provide periodic interrupted current.

When the desired anodic coating has been obtained on articles 18, the racks 19 are lifted from the electrolyte 11 in the anode tank 10 and removed from hangers 23. Racks loaded with uncoated aluminum articles are then suspended from the hangers and enter the anodizing tank in a continuous process.

The number of racks 19 which may be suspended in anodizing tank 10 at one time is limited only by the length of the tank, the number of power supplies and the speed at which conveyer 12 is moved. These are parameters which may be readily determined by one skilled in the art.

Any of the conventional electrolytes used for anodizing may be employed and do not form a part of this invention. For example sulfuric acid, oxalic acid, sulfosalicylic acid, sulfophthalic acid and mixtures thereof may be used along with additives such as the sodium lignosulfonates. The anodizing process may be carried out under a variety of temperatures ranging from about 0° F. to 100° F. which is the range conventionally used in the art.

Each power supply is adapted to supply a constant current; however, the current may vary from one supply to another as will be demonstrated. In general the articles being anodized will be subjected to a current density that may vary from about 5 to 150 amps per square foot. Obviously the voltage required to maintian a constant current may vary. Sources providing an average direct positive current interspersed with applied peaked pulses of higher level positive currents, as described in U.S. Pat. No. 3,857,766, are particularly useful in that a relative high current density may be developed at a rather low voltage. Depending upon process conditions hard anodic coatings of from about 0.25 to 10.0 mils may be obtained.

To illustrate the usefulness of this invention several examples are provided. Typical anodizing electrolytes used in the examples and the temperatures at which they were maintained are shown to simplify the discussion. Three separate power supplies are used in each example. However it is obvious that more power supplies could be used and the examples in no way intended to restrict the intent or scope of this invention.

Electrolyte A

Sulphuric Acid—175 grams per liter
Temperature—70° F.

Electrolyte B

Sulfuric Acid—250 grams per liter
Temperature—32° F.

Electrolyte C

SulfoSalicylic Acid—65 grams per liter
Sulfuric Acid—5 grams per liter
Temperature—59° F.

Electrolyte D

Sulfuric Acid—300 grams per liter
Sodium Ligno Sulfonate—1 gram per liter
Temperature—32° F.

EXAMPLE 1

Electrolyte 'B' was used and three, pulsed, direct current power supplies, as described in U.S. Pat. No. 3,857,766, were connected as described herein. Ten sheets, each having a surface area of 10 square inches, manufactured from aluminum alloy 2024, were secured on titanium racks. Three racks were used. A constant average positive current of the three power supplies were set for 50 amps and turned on. The racks were suspended in the electrolyte in a stainless steel anodizing tank and moved at the rate of 0.30 feet per minute. A segmented bus bar consisted of three 2 feet segments which were electrically isolated from each other was used. The negative terminals of each power supply were connected to the stainless steel anodizing tank. The anodic coating thickness on the parts appeared very uniform and, when measured with a Dermitron Eddy Current Instrument, the hard anodic coating thickness of all 30 parts averaged 2.5 mils. The coating thickness on the individual parts did not deviate over 0.1 mil and the variation in thickness between sheets on different racks was less than 0.2 mil.

EXAMPLE 2

The procedure of Example 1 was followed except the sheets were A380 die cast aluminum alloy having a surface area of 16 square inches each. A current setting of 40 amps was used. The parts were uniform in appearance and the hard anodic coating thickness averaged 1.1 mils. The maximum deviation in anodic coating thickness between any two sheets was less than 0.2 mil.

EXAMPLE 3

Electrolyte A was used and three conventional D.C. power supplies were connected as described herein. Twenty five aluminum alloy 6061 sheets having a surface area of 36 square inches each were racked on each of three titanium racks and the power supplies were set for 75 amps. The racks were moved at 0.3 feet per minute and the segmented bus bar consisted of three electrically isolated 3 foot lengths. The anodic coating on the sheets measured 0.6 mils with no measurable deviation in thickness between sheets.

EXAMPLE 4

Electrolyte D was used and three conventional D.C. power supplies were connected as described herein. Ten aluminum alloy 7075 sheets having a surface area of 36 square inches each were racked on each of three titanium racks and the power supplies set for 60 amps. The racks were moved at 0.1 feet per minute and the segmented bus bar consisted of three 1 foot lengths. The hard anodic coating on the parts measured 1.0 mil in thickness and the average deviation in thickness between all thirty sheets was less than 0.2 mil.

EXAMPLE 5

Electrolyte C was used and three conventional D.C. power supplies were connected as described herein. Five aluminum alloy 6063 sheets each having a surface area of 72 square inches were racked on each of three titanium racks and numbering from left to right, the first power supply was set for 40 amps, the second power supply for 60 amps, and the third power supply for 75 amps. The racks were moved at 0.2 feet per minute and the segmented bus bar consisted of three 2 feet lengths. The anodic coating on all parts was uniform bronze in color and measured 0.80 mils with no measurable deviation in coating thickness between sheets.

The above examples are not intended to restrict this invention in any way but are used to illustrate the versatility of the invention. It is obvious that an infinite number of power supplies could be used, and the anodizing tank length can be as long as desired. The number of power supplies, their amperage, the anodizing tank length and the electrolyte used can be varied to suit the work to be anodized. Thus, this invention provides a means to produce any desired type of anodic coating on articles of various sizes and various alloys at high production rates.

We claim:

1. A process for the continuous anodization of aluminum and aluminum alloy articles which comprises suspending the articles in an anodizing electrolyte and sequentially making the articles anodic by a series of two or more positive electrical currents emanating from separate electrical power supplies wherein the positive terminals of each power supply are electrically isolated from the positive terminals of every other power supply.

2. A process for the continuous anodization of aluminum and aluminum alloy articles according to claim 1 wherein the articles are suspended in an electrolyte in a common anodizing tank and are drawn through the electrolyte in the anodizing tank whereby the articles are made anodic by sequential electrical contact with the positive terminals of the power supplies.

3. A process for the continuous anodization of aluminum and aluminum alloy articles according to claim 2 wherein the positive terminals of the power supplies are connected to a segmented bus bar wherein each segment is electrically isolated from the other segments by an insulative strip and wherein each bus bar segment is connected to a single power supply.

4. A process for the continuous anodization of aluminum and aluminum alloy articles according to claim 3 wherein the articles are held in a rack suspended from a conveyer and wherein delivery of positive current from the segmented bus bar to the articles is made via a slidable electrical contact which engages and slides along the segmented bus bar and is electrically connected to said rack.

5. A process for the continuous anodization of aluminum and aluminum alloy articles according to claim 4 wherein the length of the slidable contact is slightly longer than the insulative strip between the bus bar segments such that as the slidable contact traverses the bus bar it will momentarily be in electrical contact with bus bar segments on either side of the strip.

6. A process for the continuous anodization of aluminum and aluminum alloy articles according to claim 5 wherein the rack is electrically insulated from the conveyor.

7. A process for the continuous anodization of aluminum and aluminum alloy articles according to claim 6 wherein a plurality of two or more racks are suspended in the electrolyte in the common anodizing tank at one time but are separated such that no more than one rack is in electrical contact with the positive terminal of a given power supply at a time.

8. A process for the continuous anodization of aluminum and aluminum alloy articles according to claim 7 wherein each power supply delivers a constant current.

9. A process for the continuous anodization of aluminum and aluminum alloy articles according to claim 8 wherein the constant current, supplied by each power supply may vary from one power supply to another.

10. A process for the continuous anodization of aluminum and aluminum alloy articles according to claim 4 wherein the anodizing tank is made of metal and the negative terminals of each power supply are connected to the anodizing tank.

* * * * *